US011428083B2

(12) United States Patent
Zahran

(10) Patent No.: US 11,428,083 B2
(45) Date of Patent: Aug. 30, 2022

(54) PUMPING HYDROCARBON FLUIDS FROM A WELL

(71) Applicant: Saudi Arabian Oil Company, Dhahran (SA)

(72) Inventor: Amr Mohamed Zahran, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 202 days.

(21) Appl. No.: 16/831,605

(22) Filed: Mar. 26, 2020

(65) Prior Publication Data

US 2021/0301635 A1 Sep. 30, 2021

(51) Int. Cl.

| | |
|---|---|
| ***E21B 43/12*** | (2006.01) |
| *F04B 47/02* | (2006.01) |
| *F04B 47/14* | (2006.01) |

(52) U.S. Cl.

CPC ..... *E21B 43/127* (2013.01); *F04B 47/022* (2013.01); *F04B 47/14* (2013.01)

(58) Field of Classification Search

CPC ..... E21B 43/127; F04B 47/022; F04B 47/14; F04B 47/028

See application file for complete search history.

(56) References Cited

U.S. PATENT DOCUMENTS

| | | | | |
|---|---|---|---|---|
| 2,265,379 | A * | 12/1941 | Lyne | F04B 47/02 74/41 |
| 8,950,473 | B2 | 2/2015 | Smith | |
| 9,970,420 | B2 | 5/2018 | Wang et al. | |
| 2011/0314959 | A1* | 12/2011 | Smith | E21B 43/127 74/590 |
| 2014/0234122 | A1* | 8/2014 | Donohoe | F04B 47/026 417/57 |
| 2015/0292307 | A1 | 10/2015 | Best | |
| 2016/0123124 | A1* | 5/2016 | Wang | F04B 47/022 417/410.1 |
| 2019/0338767 | A1* | 11/2019 | Robison | F04B 47/14 |
| 2020/0191136 | A1* | 6/2020 | Hoefel | F04B 47/026 |

FOREIGN PATENT DOCUMENTS

| | | |
|---|---|---|
| CN | 2336113 | 9/1999 |
| CN | 201314221 | 9/2009 |
| CN | 203035167 | 7/2013 |
| CN | 203603854 | 5/2014 |

(Continued)

OTHER PUBLICATIONS

"2008/2009 General Catalog," Lufkin Oilfield Products Group, 2008-2009, 72 pages.

(Continued)

*Primary Examiner* — Taras P Bemko
(74) *Attorney, Agent, or Firm* — Fish & Richardson P.C.

(57) ABSTRACT

A sucker rod pumping unit includes a surface beam pivotally coupled to a post assembly mountable on a multi-well pad; two horseheads, each of the two horseheads connected to a particular end of the surface beam, each of the two horseheads including a counterweight to the other of the two horseheads; two sucker rod assemblies, each of the two sucker rod assemblies attached to one of the two horseheads; and one rotary machine driveably coupled to the two sucker rod assemblies through the surface beam.

22 Claims, 3 Drawing Sheets

(56) References Cited

FOREIGN PATENT DOCUMENTS

| | | | |
|---|---|---|---|
| CN | 203603854 U | * | 5/2014 |
| CN | 205189837 | | 4/2016 |

OTHER PUBLICATIONS

Xu et al., "Rod Pumping Deviated Wells," Lufkin Automation, 2005, 14 pages.

PCT International Search Report and Written Opinion in International Appln. No. PCT/US2021/024184, dated Jul. 14, 2021, 14 pages.

* cited by examiner

PUMPING HYDROCARBON FLUIDS FROM A WELL

TECHNICAL FIELD

This disclosure relates to pumping hydrocarbon fluids from a well and, more particularly, pumping hydrocarbon fluids from two wells with a single pumping system.

BACKGROUND

Sucker rod pumping systems are common artificial lift systems for oil and gas wells and currently are widely utilized to maintain production of wells to their ultimate recovery. Typically, a single surface pumping unit is required for each well with a dedicated prime mover and sets of counter weights to provide the required counter balance effect. Such pumping units represent large capital investments and require large amounts of power.

SUMMARY

This disclosure describes implementations of a hydrocarbon pumping system that is operable to pump hydrocarbon fluids from two wells simultaneously or substantially simultaneously. In some aspects, example implementations of a hydrocarbon pumping system includes a pumping jack system (e.g., a sucker rod pumping system) that is self-balancing through two separate horsehead assemblies. In some aspects, each horsehead acts as a counterbalance weight to the other of the horseheads.

In an example implementation, a hydrocarbon pumping system includes a post assembly configured to sit on a well pad; a walking beam pivotally coupled to the post assembly; a first horsehead assembly coupled to a first end of the walking beam; and a second horsehead assembly coupled to a second end of the walking beam opposite the first end. The first horsehead assembly includes a first horsehead coupled to the first end of the walking beam, and a first sucker rod assembly coupled to the first horsehead, at least a portion of the first sucker rod assembly configured to oscillate within a first wellbore. The second horsehead assembly includes second horsehead coupled to the second end of the walking beam, and a second sucker rod assembly coupled to the second horsehead, at least a portion of the second sucker rod assembly configured to oscillate within a second wellbore different than the first wellbore. The system further includes a prime mover coupled to the walking beam and configured to driveably pivot the walking beam about the post assembly to simultaneously oscillate the first and second sucker rod assemblies within the respective first and second wellbores.

In an aspect combinable with the example implementation, the first horsehead includes a counterbalance weight to the second horsehead, and the second horsehead includes a counterbalance weight to the first horsehead.

In another aspect combinable with any of the previous aspects, the first horsehead is the only counterbalance weight to the second horsehead, and the second horsehead is the only counterbalance weight to the first horsehead.

Another aspect combinable with any of the previous aspects further includes a gear assembly coupled to the prime mover; a first pitman assembly coupled to the gear assembly and the walking beam at a first location; and a second pitman assembly coupled to the gear assembly and the walking beam at a second location different than the first location.

In another aspect combinable with any of the previous aspects, the first location is between the first end of the walking beam and a pivot point of the walking beam, and the second location is between the second end of the walking beam and the pivot point of the walking beam.

In another aspect combinable with any of the previous aspects, the prime move is a single prime mover.

In another aspect combinable with any of the previous aspects, the single prime mover includes an electric motor or a natural gas engine.

In another aspect combinable with any of the previous aspects, the single prime mover is coupled to the gear assembly though a belt or chain.

In another example implementation, a method for operating a hydrocarbon pumping system includes operating a prime mover that is coupled to a walking beam of the hydrocarbon pumping system; based on operating the prime mover, pivoting the walking beam about a pivot where the walking beam is coupled to a post assembly of the hydrocarbon pumping system; and oscillating a first horsehead assembly coupled to a first end of the walking beam by pivoting the walking beam about the pivot. The first horsehead assembly includes a first horsehead coupled to the first end of the walking beam, and a first sucker rod assembly coupled to the first horsehead. The method further includes oscillating at least a portion of the first sucker rod assembly within a first wellbore by oscillating the first horsehead assembly; and oscillating, simultaneous with oscillating the first horsehead assembly, a second horsehead assembly coupled to a second end of the walking beam opposite the first end by pivoting the walking beam about the pivot. The second horsehead assembly includes a second horsehead coupled to the second end of the walking beam, and a second sucker rod assembly coupled to the second horsehead. The method further includes oscillating at least a portion of the second sucker rod assembly within a second wellbore different than the first wellbore by oscillating the second horsehead assembly.

An aspect combinable with the example implementation further includes counterbalancing a weight of the second horsehead during oscillation of the second horsehead assembly with the first horsehead; and counterbalancing a weight of the first horsehead during oscillation of the first horsehead assembly with the second horsehead.

Another aspect combinable with any of the previous aspects further includes producing a first hydrocarbon fluid from the first wellbore by oscillating the portion of the first sucker rod assembly in the first wellbore; and producing a second hydrocarbon fluid from the second wellbore by oscillating the portion of the second sucker rod assembly in the second wellbore.

In another aspect combinable with any of the previous aspects, producing the first hydrocarbon fluid and producing the second hydrocarbon fluid occurs simultaneously or substantially simultaneously.

Another aspect combinable with any of the previous aspects further includes transferring rotary motion from the prime mover to a gear assembly coupled to the prime mover; translating rotary motion from the gear assembly to the oscillatory motion of the first horsehead assembly through a first pitman coupled between the gear assembly and the walking beam at a first location; and translating rotary motion from the gear assembly to the oscillatory motion of the second horsehead assembly through a second pitman coupled between the gear assembly and the walking beam at a second location.

In another aspect combinable with any of the previous aspects, the first location is between the first end of the walking beam and a pivot point of the walking beam, and the second location is between the second end of the walking beam and the pivot point of the walking beam.

In another aspect combinable with any of the previous aspects, the prime mover is a single prime mover.

In another aspect combinable with any of the previous aspects, the single prime mover includes an electric motor or an internal combustion engine.

In another aspect combinable with any of the previous aspects, transferring rotary motion from the prime mover to the gear assembly coupled to the prime mover includes transferring rotary motion from the single prime mover to the gear assembly coupled to the single prime mover though a belt or chain.

In another aspect combinable with any of the previous aspects, oscillating the portions of the first and second sucker rod assemblies includes: moving the portion of the first sucker rod assembly within the first wellbore in a downhole direction while moving the portion of the second sucker rod assembly within the second wellbore in an uphole direction; and moving the portion of the first sucker rod assembly within the first wellbore in an uphole direction while moving the portion of the second sucker rod assembly within the second wellbore in a downhole direction.

In another example implementation, a sucker rod pumping unit includes a surface beam pivotally coupled to a post assembly mountable on a multi-well pad; two horseheads, each of the two horseheads connected to a particular end of the surface beam, each of the two horseheads including a counterweight to the other of the two horseheads; two sucker rod assemblies, each of the two sucker rod assemblies attached to one of the two horseheads; and one rotary machine driveably coupled to the two sucker rod assemblies through the surface beam.

In an aspect combinable with the example implementation, the one rotary machine is coupled to the surface beam through a gear reducer.

In another aspect combinable with any of the previous aspects, the gear reducer is coupled to the surface beam through two link members.

In another aspect combinable with any of the previous aspects, the two link members are attached to the surface beam at opposed halves of the surface beam.

Implementations of a hydrocarbon pumping system according to the present disclosure may include one or more of the following features. For example, the hydrocarbon pumping system may provide for a multi-well pad set up for unconventional resource developments, which may benefit from drilling sets of identical adjacent wells from the same pad. As another example, the hydrocarbon pumping system may provide for a single pumping unit with a single prime mover to produce two wells simultaneously. As yet another example, the hydrocarbon pumping system may reduce or help reduce capital cost of surface pumping units, as well as reduce or help reduce a power consumption needed to operate such surface pumping units. Such capital and operating expenses may represent a significant percentage of a hydrocarbon production operating cost over a well life cycle. As another example, the hydrocarbon pumping system may eliminate a need for external balance weights to provide counter balance effects, thus further reducing a power consumption of a surface pumping system. As yet another example, the hydrocarbon pumping system may provide for a commercial benefit by reducing an amount of consumed power to produce two wells using a single prime mover, which may reduce an operational expenditure over the wells' life cycles and may make some uneconomical fields be more economical to produce.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
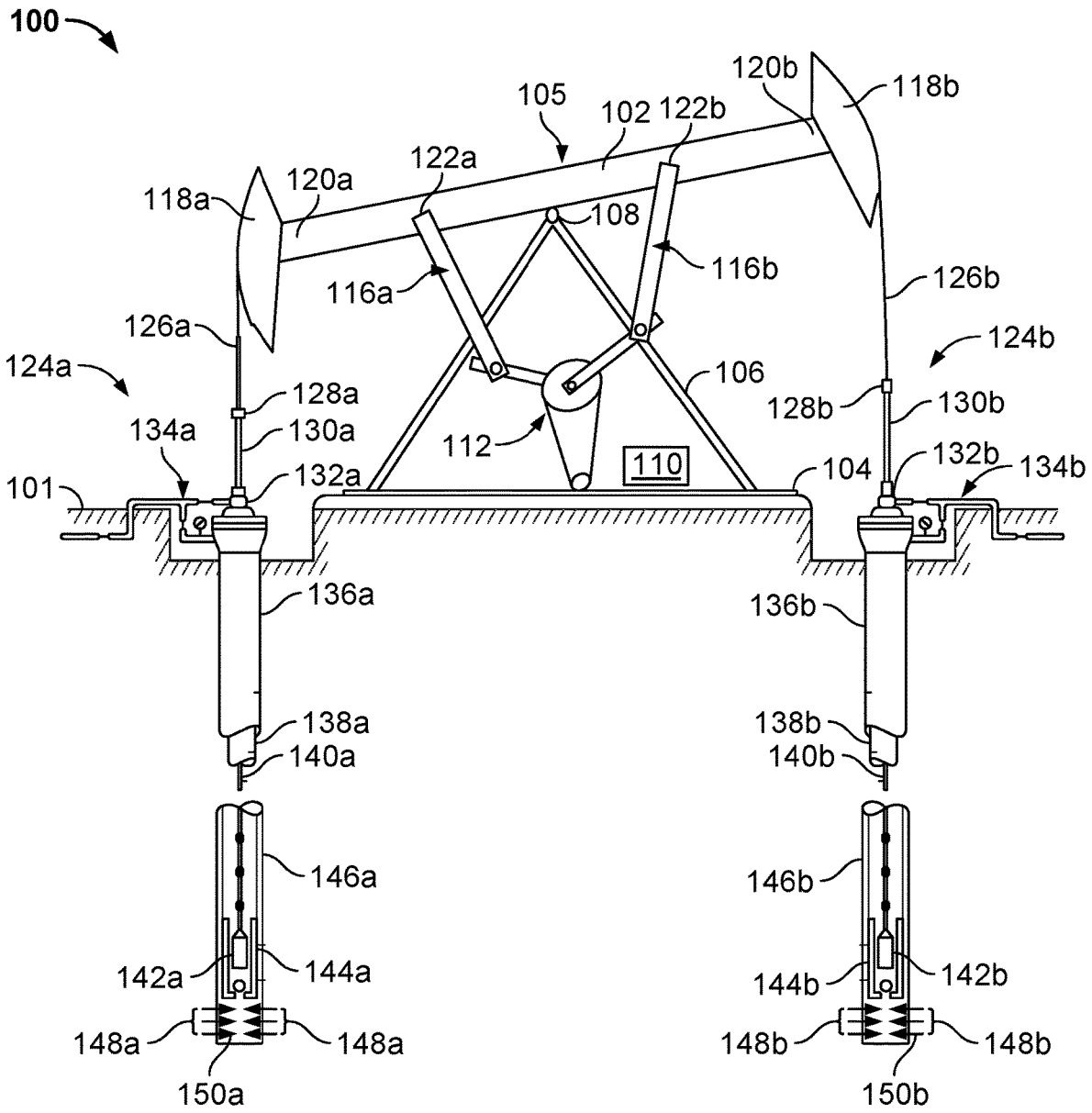
FIG. 1 is a schematic diagram of a side view of an example hydrocarbon pumping system according to the present disclosure.
Figure 2:
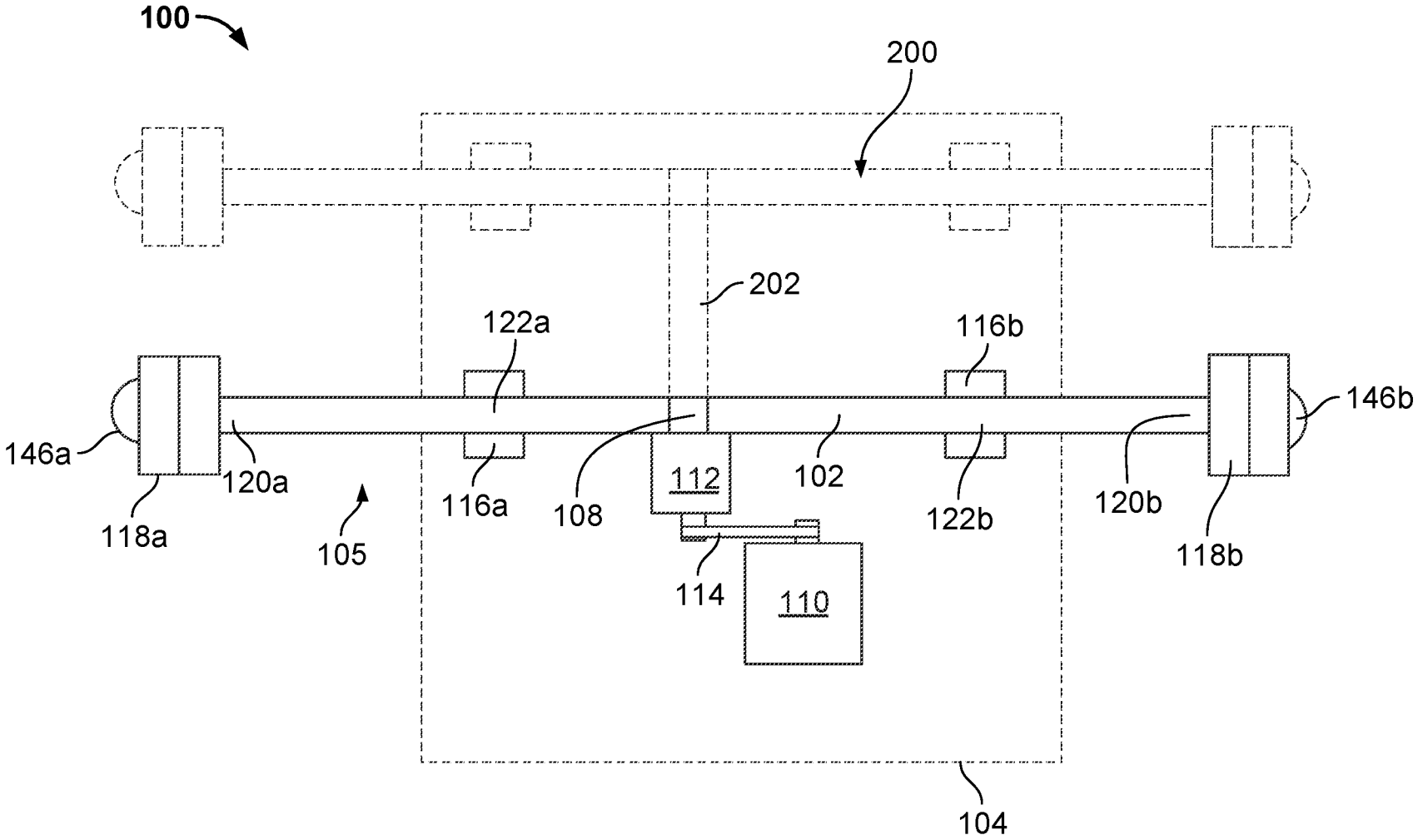
FIG. 2 is a schematic diagram of a top view of an example hydrocarbon pumping system according to the present disclosure.

FIG. 1 is a schematic diagram of a side view of an example hydrocarbon pumping system 100 according to the present disclosure. FIG. 2 is a schematic diagram of a top view of the example hydrocarbon pumping system 100. As shown in FIGS. 1 and 2, the hydrocarbon pumping system 100 includes a sucker rod pump unit 105 that is supported by or mounted on a well pad 104 that is formed on a terranean surface 101. In some aspects, the well pad 104 is a multi-well pad 104 such that multiple wells (i.e., wellbores) are formed from and produced from the single, multi-well pad 104.

The illustrated implementation of the sucker rod pump unit 105 includes a surface beam 102 (also called a walking beam 102) that is pivotally mounted to a post assembly 106 that is mounted on the well pad 104. As shown, the beam 102 is pivotally attached to the post assembly 106 at a pivot 108 (or pivot point 108). In some aspects, the pivot 108 may be near or at a lengthwise center of the surface beam 102.

Also coupled (e.g., attached) to the surface beam 102 are lever assemblies 116*a* and 116*b*, each of which is pivotally coupled to a gear assembly 112. As shown in this example, each lever assembly 116*a* and 116*b* (also called pitman 116*a* and pitman 116*b*) is attached or coupled to the surface beam 102 at an independent location on the beam 102. For example, lever assembly 116*a* is coupled to the surface beam 102 at location 122*a*, which is between the pivot 108 and a first end 120*a* of the surface beam 102. Lever assembly 116*b* is coupled to the surface beam 102 at location 122*b*, which is between the pivot 108 and a second end 120*b* of the surface beam 102. As further shown in this example, each lever assembly 116*a* and 116*b* may be comprised of multiple links, which are pivotally coupled together. In this example, for instance, each lever assembly 116*a* and 116*b* include two links that are pivotally coupled together, with one link coupled to the surface beam 102 and another link coupled to the gear assembly 112.

In the illustrated example, the gear assembly 112 may include one or multiple gears that act as gear reducer. Although the term "gear" is used, other rotary devices that link together (e.g., wheels and belts or chains, or other spoked components) and function to change and/or transfer rotational speed and movement from one component (e.g., the prime mover 110) to another component (e.g., the lever assemblies 116*a* and 116*b*) are also contemplated by the present disclosure. In some aspects, as shown in FIG. 2, a belt or chain 114, couples the prime mover 110 to the gear assembly 112. In alternative aspects, the prime mover 110 may be directly drive a portion of the gear assembly 112, e.g., so that a rotational speed of the prime mover 110 is directly transferred to at least a portion of the gear assembly 112.

In this example, the prime mover 110 may be, for instance, an electric motor, a natural gas or diesel engine, or other rotary machine that uses a fuel to generate rotational power and torque. In the illustrated implementation of the hydrocarbon pumping system 100, the prime mover 110 is a single prime mover 110, e.g., a single electric motor, or a single engine, etc. Coupled to the gear assembly 112 and therefore to the surface beam 102, the single prime mover 110 may operate to provide rotational power to the sucker rod pump unit 105 to produce hydrocarbon fluids from two wells at the same time or substantially simultaneously. In this example, the prime mover 110 and gear assembly 112 are mounted close to or at a point directly below the pivot 108.

Turning specifically to FIG. 1, the example sucker rod pump unit 105 includes two horsehead assemblies, each of which is coupled to the surface beam 102. In this figure, components of one of the horsehead assemblies are labeled with "a" reference numerals, while components of the other of the horsehead assemblies are labeled with "b" reference numerals. For example, a first horsehead assembly includes a horsehead 118*a* that is coupled or attached to the surface beam 102 at the first end 120*a* and a sucker rod assembly 124*a* coupled to the horsehead 118*a*. The sucker rod assembly 124*a* includes, in this example implementation, a bridle 126*a* that is attached to the horsehead 118*a* and is also coupled to a clamp 128*a*. The clamp 128*a* is, in turn, coupled to a rod (polished rod) 130*a* that is coupled to or part of a sucker rod 140*a*. The polished rod 130*a* and/or sucker rod 140*a* extends into a wellbore 146*a* at the terranean surface 101.

At the surface 101, a pumping tee 132*a* is positioned at a top of a surface casing 136*a*. A fluid discharge 134*a* extends from the pumping tee 132*a* and is fluidly coupled to the wellbore 146*a* to receive hydrocarbon fluids 150*a* from one or more subterranean zones under the terranean surface 101, through perforations 148*a* (e.g., through a production casing or string) and into the wellbore 146*a*. The fluid discharge 134*a* may include or connect to a hydrocarbon fluid pipeline. Also installed in the wellbore 146*a*, in this example, is a tubing string 138*a* (e.g., a production tubing string).

Attached to the sucker rod 140*a* is a plunger 142*a* that, during operation of the sucker rod pump unit 105, oscillates into and out of a barrel 144*a* within the wellbore 146*a* to lift the hydrocarbon fluids 148*a* within the wellbore 146*a* toward the surface 101 and into the fluid discharge 134*a*.

A second horsehead assembly includes a horsehead 118*b* that is coupled or attached to the surface beam 102 at the second end 120*b* and a sucker rod assembly 124*b* coupled to the horsehead 118*b*. The sucker rod assembly 124*b* includes, in this example implementation, a bridle 126*b* that is attached to the horsehead 118*b* and is also coupled to a clamp 128*b*. The clamp 128*b* is, in turn, coupled to a rod (polished rod) 130*b* that is coupled to or part of a sucker rod 140*b*. The polished rod 130*b* and/or sucker rod 140*b* extends into a wellbore 146*b* at the terranean surface 101.

At the surface 101, a pumping tee 132*b* is positioned at a top of a surface casing 136*b*. A fluid discharge 134*b* extends from the pumping tee 132*b* and is fluidly coupled to the wellbore 146*b* to receive hydrocarbon fluids 150*b* from one or more subterranean zones under the terranean surface 101, through perforations 148*b* (e.g., through a production casing or string) and into the wellbore 146*b*. The fluid discharge 134*b* may include or connect to a hydrocarbon fluid pipeline. Also installed in the wellbore 146*b*, in this example, is a tubing string 138*b* (e.g., a production tubing string).

Attached to the sucker rod 140*b* is a plunger 142*b* that, during operation of the sucker rod pump unit 105, oscillates into and out of a barrel 144*b* within the wellbore 146*b* to lift the hydrocarbon fluids 148*b* within the wellbore 146*b* toward the surface 101 and into the fluid discharge 134*b*.

In this example implementation of the sucker rod pump unit 105 and unlike conventional sucker rod pumping systems, there is no independent counterweight (i.e., a weighted component that serves only as a counterweight to the horsehead), which is typically coupled or attached to an end of a surface beam opposite a horsehead. An independent counterweight, conventionally, acts to reduce an amount of work required by the sucker rod pumping system (e.g., a prime mover of the system) during operation. In this example implementation of the sucker rod pump unit 105, the horsehead 118*a* acts as a counterbalance weight to the horsehead 118*b* during operation of the sucker rod pump unit 105, while the horsehead 118*b* acts as a counterbalance weight to the horsehead 118*a* during operation of the sucker rod pump unit 105; thus, the sucker rod pump unit 105 is self-balanced. Thus, in this example implementation of the sucker rod pump unit 105, no additional counterbalance weight components (besides the horseheads 118*a* and 118*b*) are required or necessary.

Turning specifically to FIG. 2, this figure shows an additional implementation of the hydrocarbon pumping system 100. More specifically, as shown in dashed line, an additional sucker rod pump unit 200 may be driveably coupled to the prime mover 110 through a shaft 202 (e.g., that may be coupled to a gear assembly of the sucker rod pump unit 200). The sucker rod pump unit 200 may include all are most of the components of the sucker rod pump unit 105 (except, in this example a prime mover). Thus, the prime mover 110 of the sucker rod pump unit 105 may also provide power to operate the sucker rod pump unit 200 to produce hydrocarbon fluids from two additional wellbores (in addition to wellbores 146*a* and 146*b*). In this example, the sucker rod pump unit 200 is mounted on the same multi-well pad 104 as the sucker rod pump unit 105. This disclosure also contemplates that additional sucker rod pump units 200 (in addition to the one shown in FIG. 2) may be driveably coupled to the prime mover 110.

Figure 3:
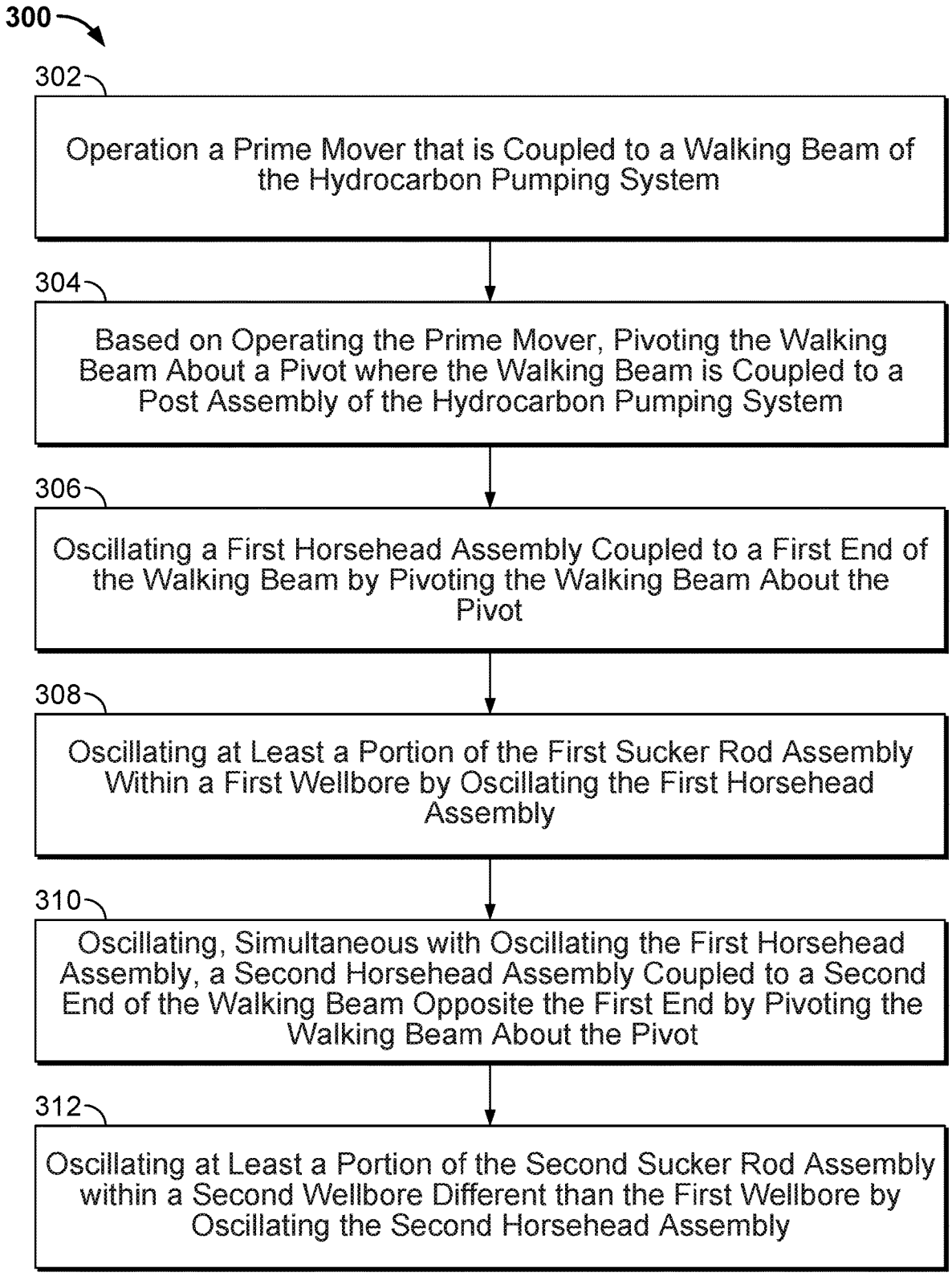
FIG. 3 is a flowchart that describes an example method performed with a hydrocarbon pumping system according to the present disclosure.

FIG. 3 is a flowchart that describes an example method 300 performed with the hydrocarbon pumping system 100, or another hydrocarbon pumping system according to the present disclosure. Method 300 may being at step 302, which includes operating a prime mover that is coupled to a walking beam of the hydrocarbon pumping system. For example, the prime mover 110, such as an electric motor or internal combustion engine, is coupled (directly or through the belt or chain 114) to the gear assembly 112, which is coupled to both of the lever assemblies 116*a* and 116*b*. As the lever assemblies 116*a* and 116*b* are coupled to the walking beam 102, the prime mover 110 is indirectly coupled to the walking beam 102.

Method 300 may continue at step 304, which includes based on operating the prime mover, pivoting the walking beam about a pivot where the walking beam is coupled to a post assembly of the hydrocarbon pumping system. For example, the prime mover 110 operates to drive the gear assembly 112, which is coupled to both of the lever assemblies 116*a* and 116*b*. As the lever assemblies 116*a* and 116*b* are coupled to the walking beam 102, the rotational power of the prime mover 110 is translated to pivotal movement of the walking beam 102 about the pivot 108.

Method 300 may continue at step 306, which includes oscillating a first horsehead assembly coupled to a first end of the walking beam by pivoting the walking beam about the pivot. For example, as the walking beam 102 pivots about the pivot 108, the horsehead 118*a* moves up and down in a linear or slightly curved path.

Method 300 may continue at step 308, which includes oscillating at least a portion of the first sucker rod assembly within a first wellbore by oscillating the first horsehead assembly. For example, when the horsehead 118*a* is moving up and down in the linear or slightly curved, the sucker rod assembly 124*a* oscillates in an upward and downward motion, following the motion of the horsehead 118*a*. Thus, as the sucker rod assembly 124*a* oscillates, at least the sucker rod 140*a* (and plunger 142*a*) oscillate in the wellbore 146*a*.

Method 300 may continue at step 310, which includes oscillating, simultaneous with oscillating the first horsehead assembly, a second horsehead assembly coupled to a second end of the walking beam opposite the first end by pivoting the walking beam about the pivot. For example, as the walking beam 102 pivots about the pivot 108, the horsehead 118*b* moves up and down in a linear or slightly curved path. As the horsehead 118*b* is connected to an opposite end of the walking beam 102 from the horsehead 118*a*, the horsehead 118*b* moves substantially in an opposite direction (with respect to gravity) as the horsehead 118*a*. Thus, as the horsehead 118*b* moves up (with respect to gravity), the horsehead 118*a* moves down (with respect to gravity). As the horsehead 118*a* moves up (with respect to gravity), the horsehead 118*b* moves down (with respect to gravity).

Method 300 may continue at step 312, which includes oscillating at least a portion of the second sucker rod assembly within a second wellbore different than the first wellbore by oscillating the second horsehead assembly. For example, when the horsehead 118*b* is moving up and down in the linear or slightly curved, the sucker rod assembly 124*b* oscillates in an upward and downward motion, following the motion of the horsehead 118*b*. Thus, as the sucker rod assembly 124*b* oscillates, at least the sucker rod 140*b* (and plunger 142*b*) oscillate in the wellbore 146*b*.

By oscillating both portions of the sucker rod assemblies 124*a* and 124*b*, the hydrocarbon pumping system 100 may produce (and method 300 may include a step of producing) hydrocarbon fluids 150*a* and 150*b* from both of wellbores 146*a* and 146*b* using prime mover 110 (e.g., a single prime mover 110). In some aspects, hydrocarbon fluids 150*a* and 150*b* may be produced (e.g., circulated to and through the fluid discharges 134*a* and 134*b*, respectively) at the same time, i.e., simultaneously. In some aspects, such as due to the opposed oscillation of the respective sucker rod assemblies 124*a* and 124*b* in which one of the sucker rod assemblies is moving uphole while the other of the sucker rod assemblies is moving downhole, hydrocarbon fluids 150*a* and 150*b* may be produced (e.g., circulated to and through the fluid discharges 134*a* and 134*b*, respectively) sequentially, i.e., substantially simultaneously.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A hydrocarbon pumping system, comprising:

a post assembly configured to sit on a well pad;

a walking beam pivotally coupled to the post assembly;

a first horsehead assembly coupled to a first end of the walking beam, the first horsehead assembly comprising:

a first horsehead coupled to the first end of the walking beam, and a first sucker rod assembly coupled to the first horsehead, at least a portion of the first sucker rod assembly configured to oscillate within a first wellbore;

a second horsehead assembly coupled to a second end of the walking beam opposite the first end, the second horsehead assembly comprising:

a second horsehead coupled to the second end of the walking beam, where the first horsehead is the only counterbalance weight to the second horsehead, and the second horsehead is the only counterbalance weight to the first horsehead, and a second sucker rod assembly coupled to the second horsehead, at least a portion of the second sucker rod assembly configured to oscillate within a second wellbore different than the first wellbore;

a prime mover coupled to the walking beam and configured to driveably pivot the walking beam about the post assembly to simultaneously oscillate the first and second sucker rod assemblies within the respective first and second wellbores;

a single gear assembly coupled to the prime mover and to the walking beam, the single gear assembly comprising a belt or chain that driveably connects the prime mover to the single gear assembly;

a first pitman assembly that comprises a first lever assembly that comprises a first link pivotally coupled to a second link, the first link coupled to the single gear assembly at a first gear location and the second link coupled to the walking beam at a first location; and a second pitman assembly that comprises a second lever assembly that comprises a first link pivotally coupled to a second link, the first link coupled to the single gear assembly at a second gear location different than the first gear location and the second link coupled to the walking beam at a second location different than the first location.

2. The hydrocarbon pumping system of claim 1, wherein the first location is between the first end of the walking beam and a pivot point of the walking beam, and the second location is between the second end of the walking beam and the pivot point of the walking beam.

3. The hydrocarbon pumping system of claim 1, wherein the prime mover is a single prime mover.

4. The hydrocarbon pumping system of claim 3, wherein the single prime mover comprises an electric motor or a natural gas engine.

5. The hydrocarbon pumping system of claim 4, wherein the single prime mover is the natural gas engine.

6. The hydrocarbon pumping system of claim 3, wherein the single prime mover is coupled to the single gear assembly though the belt or chain.

7. The hydrocarbon pumping system of claim 3, wherein the first location is between the first end of the walking beam and a pivot point of the walking beam, and the second location is between the second end of the walking beam and the pivot point of the walking beam.

8. A method for operating a hydrocarbon pumping system, the method comprising:

operating a prime mover that is coupled to a walking beam of the hydrocarbon pumping system;

transferring rotary motion from the prime mover to a single gear assembly coupled to the prime mover through a belt or chain;

based on operating the prime mover, transferring the rotary motion from the single gear assembly to pivot the walking beam about a pivot where the walking beam is coupled to a post assembly of the hydrocarbon pumping system;

oscillating a first horsehead assembly coupled to a first end of the walking beam by pivoting the walking beam about the pivot, the first horsehead assembly comprising a first horsehead coupled to the first end of the walking beam, and a first sucker rod assembly coupled to the first horsehead;

oscillating at least a portion of the first sucker rod assembly within a first wellbore by oscillating the first horsehead assembly;

oscillating, simultaneous with oscillating the first horsehead assembly, a second horsehead assembly coupled to a second end of the walking beam opposite the first end by pivoting the walking beam about the pivot, the second horsehead assembly comprising a second horsehead coupled to the second end of the walking beam, and a second sucker rod assembly coupled to the second horsehead;

counterbalancing a weight of the second horsehead during oscillation of the second horsehead assembly with only the first horsehead;

counterbalancing a weight of the first horsehead during oscillation of the first horsehead assembly with only the second horsehead;

oscillating at least a portion of the second sucker rod assembly within a second wellbore different than the first wellbore by oscillating the second horsehead assembly;

translating rotary motion from the single gear assembly to the oscillatory motion of the first horsehead assembly through a first pitman assembly that comprises a first lever assembly that comprises a first link pivotally coupled to a second link, the first link coupled to the single gear assembly at a first gear location and the second link coupled to the walking beam at a first location; and translating rotary motion from the single gear assembly to the oscillatory motion of the second horsehead assembly through a second pitman assembly that comprises a second lever assembly that comprises a first link pivotally coupled to a second link, the first link coupled to the single gear assembly at a second gear location different than the first gear location and the second link coupled to the walking beam at a second location different than the first location.

9. The method of claim 8, further comprising:

producing a first hydrocarbon fluid from the first wellbore by oscillating the portion of the first sucker rod assembly in the first wellbore; and producing a second hydrocarbon fluid from the second wellbore by oscillating the portion of the second sucker rod assembly in the second wellbore.

10. The method of claim 9, wherein producing the first hydrocarbon fluid and producing the second hydrocarbon fluid occurs simultaneously or substantially simultaneously.

11. The method of claim 8, wherein the first location is between the first end of the walking beam and a pivot point of the walking beam, and the second location is between the second end of the walking beam and the pivot point of the walking beam.

12. The method of claim 8, wherein the prime mover is a single prime mover.

13. The method of claim 12, wherein the single prime mover comprises an electric motor or an internal combustion engine.

14. The method of claim 12, wherein transferring rotary motion from the prime mover to the single gear assembly coupled to the prime mover comprises transferring rotary motion from the single prime mover to the single gear assembly coupled to the single prime mover though the belt or chain.

15. The method of claim 12, wherein oscillating the portions of the first and second sucker rod assemblies comprises:

moving the portion of the first sucker rod assembly within the first wellbore in a downhole direction while moving the portion of the second sucker rod assembly within the second wellbore in an uphole direction; and moving the portion of the first sucker rod assembly within the first wellbore in an uphole direction while moving the portion of the second sucker rod assembly within the second wellbore in a downhole direction.

16. The method of claim 12, wherein the first location is between the first end of the walking beam and a pivot point of the walking beam, and the second location is between the second end of the walking beam and the pivot point of the walking beam.

17. The method of claim 8, wherein oscillating the portions of the first and second sucker rod assemblies comprises:

moving the portion of the first sucker rod assembly within the first wellbore in a downhole direction while moving the portion of the second sucker rod assembly within the second wellbore in an uphole direction; and moving the portion of the first sucker rod assembly within the first wellbore in an uphole direction while moving the portion of the second sucker rod assembly within the second wellbore in a downhole direction.

18. A sucker rod pumping unit, comprising:

a first surface beam pivotally coupled to a first post assembly mountable on a multi-well pad;

a second surface beam pivotally coupled to a second post assembly mountable on the multi-well pad;

a first horsehead sub-system, comprising:

a first set of two horseheads, each of the two horseheads connected to a particular end of the first surface beam, each of the two horseheads comprising a sole counterweight to the other of the two horseheads; and a first set of two sucker rod assemblies, each of the two sucker rod assemblies attached to one of the two horseheads of the first set of horseheads;

a first assembly that comprises a first lever assembly that comprises a first link pivotally coupled to a second link, the first link coupled to a gear assembly at a first gear location and the second link coupled to the first surface beam at a first location; and a second pitman assembly that comprises a second lever assembly that comprises a first link pivotally coupled to a second link, the first link coupled to the gear assembly at a second gear location different than the first gear location and the second link coupled to the first surface beam at a second location different than the first location;

a second horsehead sub-system, comprising:

a second set of two horseheads, each of the two horseheads connected to a particular end of the second surface beam, each of the two horseheads comprising a sole counterweight to the other of the two horseheads; and a second set of two sucker rod assemblies, each of the two sucker rod assemblies attached to one of the two horseheads of the second set of horseheads; and one rotary machine driveably coupled to the first set of two sucker rod assemblies through the first surface beam and to the second set of two sucker rod assemblies through the second surface beam with a single shaft.

19. The sucker rod pumping unit of claim 18, wherein the one rotary machine is coupled to at least one of the first or second surface beams through a gear reducer.

20. The sucker rod pumping unit of claim 19, wherein the gear reducer is coupled to the at least one of the first or second surface beams through two link members.

21. The sucker rod pumping unit of claim 20, wherein the two link members are attached to the at least one of the first or second surface beams at opposed halves of the surface beam.

22. The sucker rod pumping unit of claim 18, further comprising a gear assembly that couples the one rotary machine to the first and second surface beams, the gear assembly comprising a belt or chain.

* * * * *